US009805699B1

(12) United States Patent
Johnson

(10) Patent No.: US 9,805,699 B1
(45) Date of Patent: Oct. 31, 2017

(54) GUITAR ARM REST

(71) Applicant: Timothy L. Johnson, Eureka, IL (US)

(72) Inventor: Timothy L. Johnson, Eureka, IL (US)

( * ) Notice: Subject to any disclaimer, the term of this patent is extended or adjusted under 35 U.S.C. 154(b) by 0 days.

(21) Appl. No.: 15/442,635

(22) Filed: Feb. 25, 2017

Related U.S. Application Data

(60) Provisional application No. 62/300,238, filed on Feb. 26, 2016.

(51) Int. Cl.
*G10D 3/18* (2006.01)

(52) U.S. Cl.
CPC ..... *G10D 3/18* (2013.01)

(58) Field of Classification Search
CPC G10G 5/005; G10G 5/00; G10D 3/18; G10D 7/00
See application file for complete search history.

(56) References Cited

U.S. PATENT DOCUMENTS 7,205,468 B1 * 4/2007 Johnson ..... G10G 5/005 84/327

* cited by examiner

*Primary Examiner* — Kimberly Lockett
(74) *Attorney, Agent, or Firm* — Edwin H. Crabtree; Ramon L. Pizarro

(57) ABSTRACT

A guitar arm rest adapted for mounting on a side of a guitar for holding a guitar player's arm in a proper position on the guitar. The guitar arm rest includes an arm rest cup received next to an edge of the side of the guitar. A front of the arm rest cup is adapted for receiving the guitar player's arm thereon. A base plate is hinged to a back of the arm rest cup. The base plate includes one or more suction cups for securing the guitar rest on the side of the guitar. One end of a height adjustment pivot plate is hinged on the base plate. An opposite end of the pivot plate is received in a selected hole in a hole track plate. The hole track plate is attached to a rear of the arm rest cup. The pivot plate is used to adjust the height/angle of the arm rest cup above the side of the guitar.

16 Claims, 2 Drawing Sheets

GUITAR ARM REST

This non-provisional patent application claims the benefit of the subject matter and filing date of a provisional patent application, Ser. No. 62/300,238, filed on Feb. 26, 2016, by the subject inventor.

BACKGROUND OF THE INVENTION

(a) Field of the Invention

This invention relates to a musical instrument arm rest, and more particularly, but not by way of limitation, to a guitar arm rest used for playing a classical guitar and other stringed instruments.

(b) Discussion of Prior Art

Heretofore, there have been a number of different types of arm rests and leg rests for holding a guitar away from a guitar player's arm and above a player's leg. A combination guitar rest and leg rest is disclosed in U.S. Pat. No. 7,205,468 to the subject inventor. This prior art reference and other guitar arm rests don't have the unique features and advantages of the subject arm rest as disclosed herein.

SUMMARY OF THE INVENTION

In view of the foregoing, it is a primary objective of the subject invention to provide an adjustable arm and forearm rest that allows the guitar player to customize the arm angle next to the guitar according to the player's specific body type, dimensions and playing angle.

Another object of the invention is the player can slide the arm along an arm rest plate to achieve different tonal colors and harmonies without loss of arm support and ease of arm motion. The arm rest provides full support of the arm next to the side of the guitar.

Yet another object of the arm rest is it allows the player to rest his or her forearm on a greater flat surface diffusing pressure on the tendons and avoiding a ninety degree angle at an edge of a side of the guitar, which typically digs into forearm's tendons and muscle.

Still another key object of the invention is the arm rest is adjustable from zero to 60 degrees and greater from a horizontal surface on the side of the guitar These and other objects of the present invention will become apparent to those familiar with different types of arm and leg rests used with a musical instrument when reviewing the following detailed description and drawings, showing novel construction, and a combination of structural elements not disclosed by the prior art.

DESCRIPTION OF THE DRAWINGS

The accompanying drawings illustrate complete preferred embodiments of the present invention according to the best modes presently devised for the practical application of the subject arm rest, and in which.

DETAILED DESCRIPTION OF THE PREFERRED EMBODIMENTS

Figure 1:
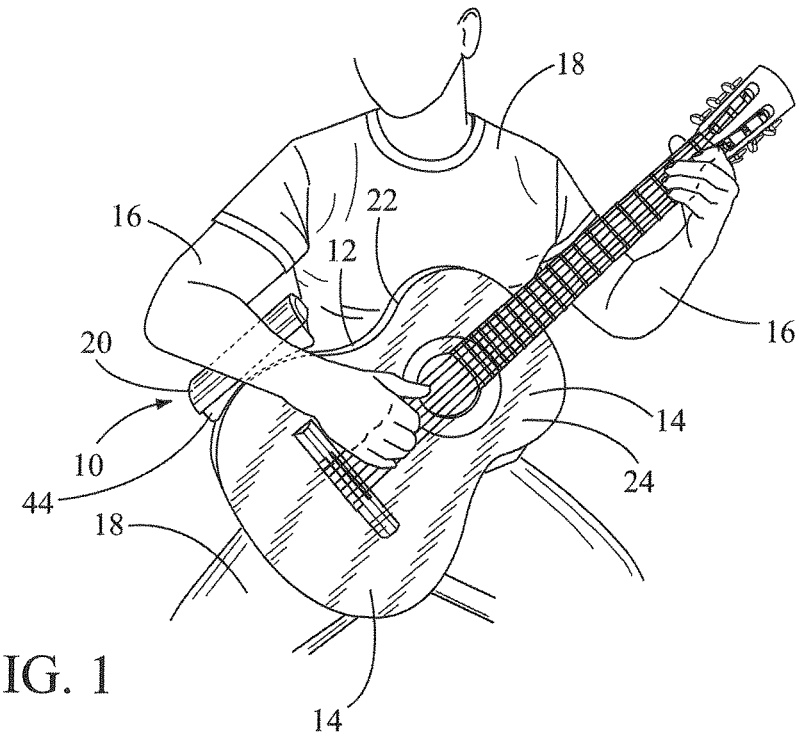
FIG. 1 is a perspective view of the subject guitar arm rest attached to a side of a guitar, with an arm of a guitar player resting on the arm rest.

In FIG. 1, a perspective view of the subject guitar arm rest is shown having a general reference numeral 10. The arm rest 10 is illustrated attached to a side 12 of a guitar 14. An arm 16 of a guitar player 18 is shown resting on top of a contoured, inverted, arm rest cup 20, which is hinged next to an edge 22 of the side 12 and a face 24 of the guitar 14. Also and its simplest form, the arm rest 10 can be attached to the side 12 of the guitar 14 and the contour of the arm rest cup 20 used for proper positioning of the arm 16, without being hinged thereto.

Figure 2:
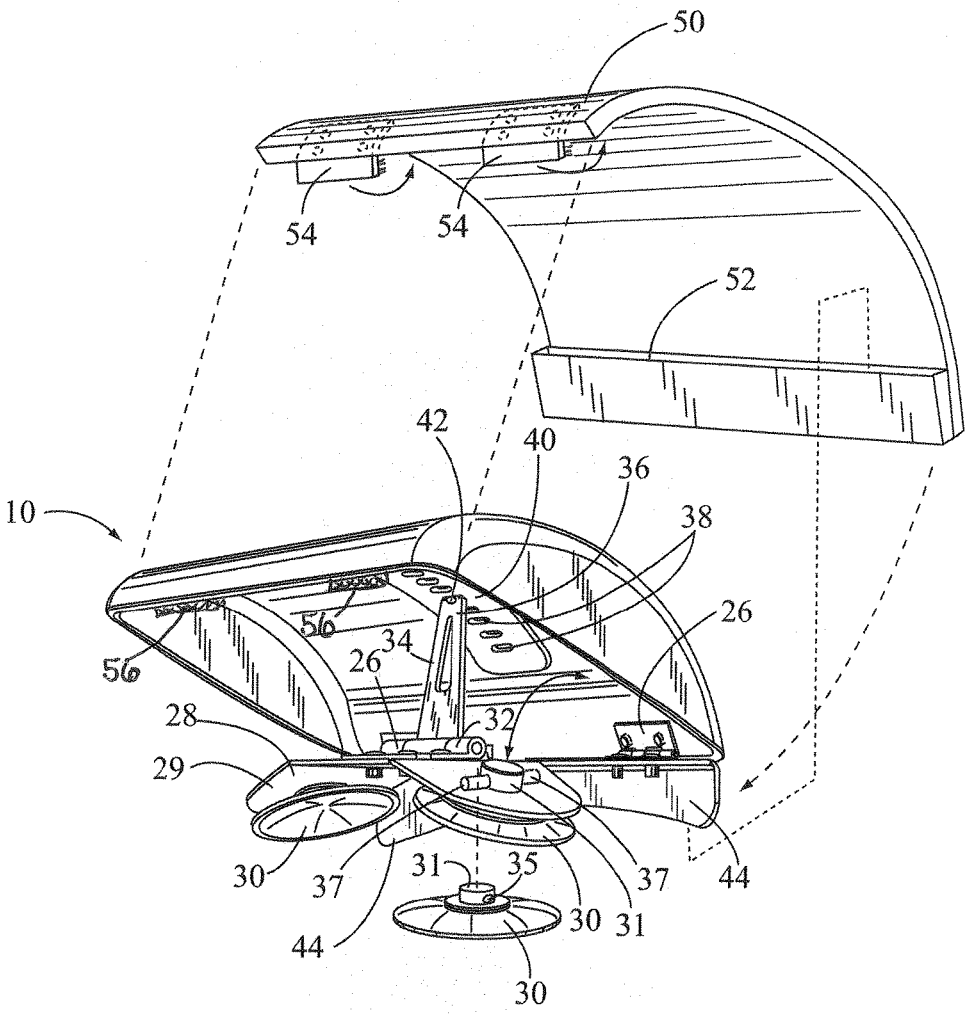
FIG. 2 is a bottom perspective view of the guitar arm rest and held in a raised position prior to attachment to the guitar.

In FIG. 2, an enlarged perspective view of the arm rest 10 is shown with one end of the arm rest cup 20 having a pair of hinges 26 attached to opposite ends of a base plate 28. The base plate 28 includes one or more suction cups 30, used to secure the arm rest 10 to the side 12 of the guitar 14. In this drawing, the base plate 28 includes three suction cups 30 for attaching the arm rest 10 to the guitar.

In this example of the base plate 28, the plate has opposite end portions 29, bent at a 20 degree angle from a horizontal center of the base plate. This feature allows the base plate 28 and suction cups 30 to conform to a curvature of the side 12 of the guitar 14. The suction cups 30 having a mounting post 31, which extends upwardly through a mounting post hole 33 in the base plate 28. The top of the mounting post 31 includes a standoff hole 35 for receiving a standoff pin 37. By releasing the standoff pin 37 from the standoff hole 35, the base plate 28 can be lifted upwardly and removed from the suction cups 30. In this manner, the guitar arm rest 10 can be removed from the side of the guitar until the arm rest 10 is again needed.

Mounted on the base plate 28 is a hinge 32. The hinge 32 is connected to one end of a height adjustment pivot plate 34. In this drawing, a tapered opposite end 36 of the pivot plate 34 is shown received in a hole 38. The hole 38 is part of a series of holes 38 along a length of a hole track plate 40, attached to an inside of the arm rest cup 20. The tapered end 36 of the pivot plate 32 can include a magnet 42, or similar fastener, for holding it in place on the track plate 40. By using the pivot plate 34, a hole 40 can be selected on the track plate 40 for raising the arm rest cup 20 from a horizontal position, next to the side 12, upwardly at an angle "Δ". This angle can be in a range of zero degrees, by lowering the pivot arm next to the top of the base plate 28, up to 90 degrees on the track plate 40, for receiving the player's arm 16 thereon.

Figure 3:
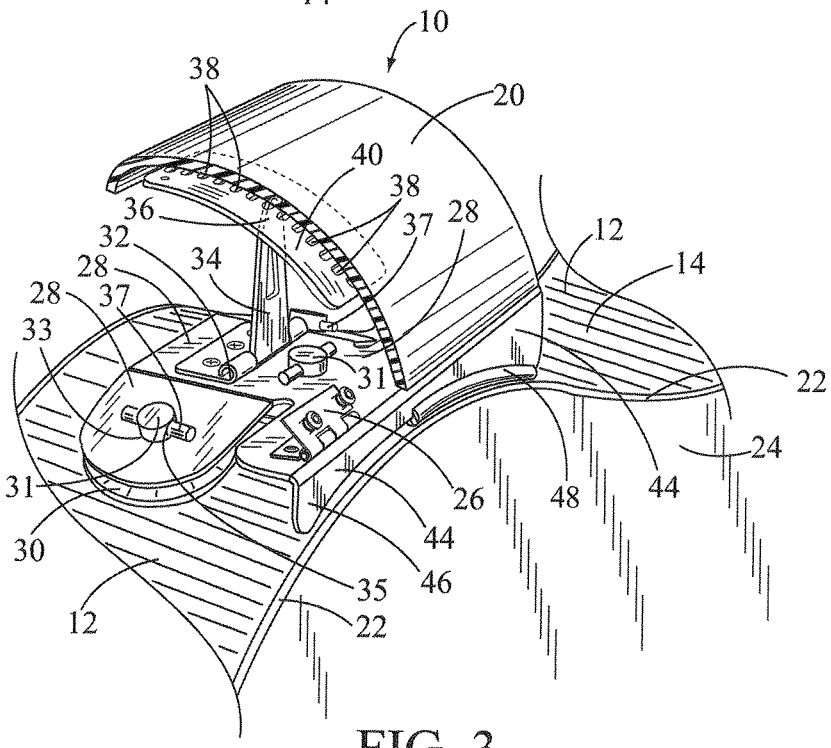
FIG. 3 is another perspective view of the arm rest attached to the side of the guitar with a portion of a contoured, inverted, arm rest cup. A portion of the arm rest cup is shown cut away.

In FIG. 3, another perspective view of the arm rest 10 is shown attached to the side 12 of the guitar 14 with a portion of a contoured, inverted, arm rest cup 20 cut away. In this drawing, the base plate 28 is shown with a skirt 44 bent at a 90 degree angle from the base plate. The skirt 44 and the base plate 28 are contoured to follow the contour of the side 12 of the guitar 14. A lower edge 46 of the contoured skirt is shown resting on top of the edge 22 of the guitar. In this manner, the arm rest 10 can be placed at various position along the side 12 of the guitar 14 for proper adjustment of the guitar player's arm 16. Also, the lower edge 46 of the skirt 44 can include a rubber edge trim 48 to protect a polished finish on the guitar 14.

Referring back to FIG. 2, the guitar arm rest 10 can include a slip cover 50 for receipt over the top of the arm rest cup 20. This feature is important when a guitar player 18 is shirtless and his or her arm 16 might stick on the hard plastic surface of the cup 20. For securing the slip cover 50 on the cup 20, the cover at one end includes a lip or pocket 52, which is received around the skirt 44. The slip cover 50 is than folded over the top of the arm rest cup 20. An opposite side of the slip cover includes hook fastener 54, which are attached to loop fasteners 56 disposed on the inside of the arm rest cup 20.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed as follows:

1. A guitar arm rest adapted for mounting on a side of a guitar for holding a guitar player's arm in a proper position on the guitar, the guitar arm rest comprising:

a contoured, inverted, arm rest cup adapted for receipt next to an edge of the side of the guitar, a front of the arm rest cup adapted for receiving the guitar player's arm thereon;

a base plate hinged to the rear of the arm rest cup;

at least one suction cup attached to the base plate, the suction cup adapted for securing the guitar arm rest on the side of the guitar;

a height adjustment pivot plate, one end of the pivot plate hinged on the base plate; and a hole track plate with a plurality of holes along a length of the track plate, the hole track plate attached to a rear of the arm rest cup, an opposite end of the pivot plate received in a selected hole on the track plate for adjusting the height of the arm rest cup.

2. The arm rest as described in claim 1 wherein the opposite end of the pivot plate is tapered for receipt in a selected hole in the hole track plate.

3. The arm rest as described in claim 2 wherein the tapered end of the pivot plate includes a magnet or similar fastener for holding the pivot plate on the track plate.

4. The arm rest as described in claim 1 wherein the pivot plate holds the track plate and the arm rest cup from a horizontal position upwardly at an angle "Δ", in a range of zero degrees to 90 degrees.

5. The arm rest as described in claim 1 wherein the suction cup includes a mounting post for receipt in a mounting post hole in the base plate and held thereon using a standoff pin received through a standoff pin hole in the mounting post.

6. A guitar arm rest adapted for mounting on a side of a guitar for holding a guitar player's arm in a proper position on the guitar, the guitar arm rest comprising:

a contoured, inverted, arm rest cup adapted for receipt next to an edge of the side of the guitar, a front of the arm rest cup adapted for receiving the guitar player's arm thereon;

a base plate hinged to the rear of the arm rest cup;

three suction cups, one suction cup attached to a center of the base plate, two of the suction cups attached to opposite ends of the base plate, the suction cups releasably attached to the base plate, the suction cups adapted for securing the guitar arm rest on the side of the guitar;

a height adjustment pivot plate, one end of the pivot plate hinged on the base plate; and a hole track plate with a plurality of holes along a length of the track plate, the hole track plate attached to a rear of the arm rest cup, a tapered opposite end of the pivot plate received in a selected hole on the track plate for adjusting the height of the arm rest cup.

7. The arm rest as described in claim 6 wherein the tapered end of the pivot plate includes a magnet or similar fastener for holding the pivot plate on the track plate.

8. The arm rest as described in claim 6 wherein the pivot plate holds the track plate and the arm rest cup from a horizontal position upwardly at an angle "Δ", in a range of zero degrees to 90 degrees.

9. The arm rest as described in claim 6 wherein the suction cups includes a mounting post for receipt in a mounting post hole in the base plate and held thereon using a standoff pin received through a standoff pin hole in the mounting post.

10. The arm rest as described in claim 6 wherein the base plate includes a contoured skirt, the contoured skirt adapted for receipt on an edge of the side of the guitar.

11. The arm rest as described in claim 10 further including a rubber edge trim received on a lower edge of the contoured skirt, the edge trim adapted for protecting a polish on the side of the guitar.

12. The arm rest as described in claim 10 further including a slip cover, the slip cover having a pocket on one side for receipt around the contoured skirt, the slip cover including hook fasteners for securing an opposite side of the slip cover to loop fasteners on an under side of the arm rest cup.

13. A guitar arm rest adapted for mounting on a side of a guitar for holding a guitar player's arm in a proper position on the guitar, the guitar arm rest comprising:

an arm rest cup adapted for receipt on the side of the guitar and attached thereto, a front or a top of the arm rest cup adapted for receiving the guitar player's arm thereon, a base plate hinged to the arm rest cup;

at least one suction cup attached to the base plate, the suction cup adapted for securing the guitar arm rest on the side of the guitar;

a height adjustment pivot plate, one end of the pivot plate hinged on the base plate; and a hole track plate with a plurality of holes along a length of the track plate, the hole track plate attached to a rear of the arm rest cup, an opposite end of the pivot plate received in a selected hole on the track plate for adjusting the height of the arm rest cup.

14. The arm rest as described in claim 13 wherein the opposite end of pivot plate is tapered for receipt in a selected hole in the hole track plate.

15. The arm rest as described in claim 14 wherein the tapered end of the pivot plate includes a magnet or similar fastener for holding the pivot plate on the track plate.

16. The arm rest as described in claim 13 wherein the pivot plate holds the track plate and the arm rest cup from a horizontal position upwardly at an angle "Δ", in a range of zero degrees to 90 degrees.

* * * * *